US007871463B2

(12) United States Patent
Hayama et al.

(10) Patent No.: US 7,871,463 B2
(45) Date of Patent: Jan. 18, 2011

(54) DUST COLLECTION DEVICE

(75) Inventors: Yoshimasa Hayama, Hitachinaka (JP); Daisuke Kakegawa, Hitachinaka (JP); Kumio Takahashi, Hitachinaka (JP); Masahiro Inaniwa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 357 days.

(21) Appl. No.: 12/050,971

(22) Filed: Mar. 19, 2008

(65) Prior Publication Data

US 2008/0229719 A1 Sep. 25, 2008

(30) Foreign Application Priority Data

Mar. 19, 2007 (JP) ..... P2007-071641

(51) Int. Cl.
*B01D 46/00* (2006.01)

(52) U.S. Cl. ..... 96/425; 55/283; 55/295; 55/DIG. 3; 55/DIG. 34; 15/352

(58) Field of Classification Search ..... 55/283, 55/300, 467, 471, 472, 473, DIG. 3, DIG. 34, 55/295, 296; 96/397, 398, 399, 403, 404, 96/408, 428, 429, 430, 226, 424, 425; 15/347, 15/352; 95/26, 282
See application file for complete search history.

(56) References Cited

U.S. PATENT DOCUMENTS 3,667,084 A * 6/1972 Valbona et al. ..... 15/323
3,695,006 A * 10/1972 Valbona et al. ..... 96/420
3,906,756 A * 9/1975 Bone ..... 68/18 F
4,545,794 A * 10/1985 Himukai ..... 55/362
5,240,484 A * 8/1993 Genovese et al. ..... 96/226
5,352,255 A * 10/1994 Taft ..... 96/419
5,914,453 A * 6/1999 James et al. ..... 95/14
6,117,200 A * 9/2000 Berg et al. ..... 55/287
6,228,155 B1 * 5/2001 Tai ..... 96/413
6,626,973 B2 * 9/2003 Park ..... 55/480
6,660,070 B2 * 12/2003 Chung et al. ..... 96/424
6,712,868 B2 * 3/2004 Murphy et al. ..... 55/330
6,984,252 B2 * 1/2006 Tanimoto ..... 55/385.1
7,303,613 B2 * 12/2007 Rosenzweig ..... 96/421
7,309,365 B2 * 12/2007 Yuasa et al. ..... 55/283

FOREIGN PATENT DOCUMENTS

JP 60-212140 10/1985
JP 9-843 1/1997

* cited by examiner

*Primary Examiner*—Duane Smith
*Assistant Examiner*—Minh-Chau Pham
(74) *Attorney, Agent, or Firm*—Antonelli, Terry, Stout & Kraus, LLP.

(57) ABSTRACT

A dust collection device has a tank, a suction unit, a filtering unit, a dust removal unit, a first detection unit, and a control unit. The tank has an air inlet for accommodating dust. The suction unit aspirates the dust through the air inlet. The filtering unit captures the dust through the air inlet. The dust removal unit removes the dust from the filtering unit. The first detection unit detects an operational state of the suction unit. The control unit controls the suction unit and the dust removal unit. The control unit activates the dust removal unit, when the first detection unit detects that the suction unit operates for a first predetermined time period and then stops operating.

8 Claims, 5 Drawing Sheets

DUST COLLECTION DEVICE

TECHNICAL FIELD

The present invention relates to a dust collection device having a dust removal unit for cleaning a filter unit of the dust collection device.

BACKGROUND

Generally, dust collectors are designed to aspirate external air into a tank having an air inlet port by means of a suction device, filter off powdery dust from the aspirated air including the dust, collect the filtered powdery dust and discharge the air cleaned by the filtering.

The filter fitted to a dust collector collects the powdery dust produced by an electric tool. When the entire surface of the filter is clogged with the powdery dust, the filter can quickly become fully loaded with the dust to reduce the air suction effect thereof. Then, the filter needs to be cleaned. The filter is generally required to be removed from the dust collector before the filter is cleaned.

With conventional dust collectors, each time the operator visually finds that the filter is clogged, the dust clogging the filter needs to be manually removed, which is a cumbersome operation. Additionally, since a unit is not provided for the operator to directly recognize a clogged condition of the filter, the operator is required to judge the clogged condition of the filter on the basis of his or her experience and/or the phenomenon that the suction force of the filter has fallen and the filter can no longer aspirate the powdery dust effectively.

SUMMARY

An object of the present invention is to provide a dust collection device from which dust can be easily removed in accordance with the operating condition of the dust collection device.

The present invention provides a dust collection device having a tank, a suction unit, a filtering unit, a dust removal unit, a first detection unit, and a control unit. The tank has an air inlet for accommodating dust. The suction unit aspirates the dust through the air inlet. The filtering unit captures the dust through the air inlet. The dust removal unit removes the dust from the filtering unit. The first detection unit detects an operational state of the suction unit. The control unit controls the suction unit and the dust removal unit. The control unit activates the dust removal unit, when the first detection unit detects that the suction unit operates for a first predetermined time period and then stops operating.

BRIEF DESCRIPTION OF THE DRAWINGS

The particular features and advantages of the invention as well as other objects will become apparent from the following description taken in connection with the accompanying drawings, in which.

DETAILED DESCRIPTION

A dust collection device according to an embodiment of the present invention will be described by referring to the accompanying drawings.

Figure 1:
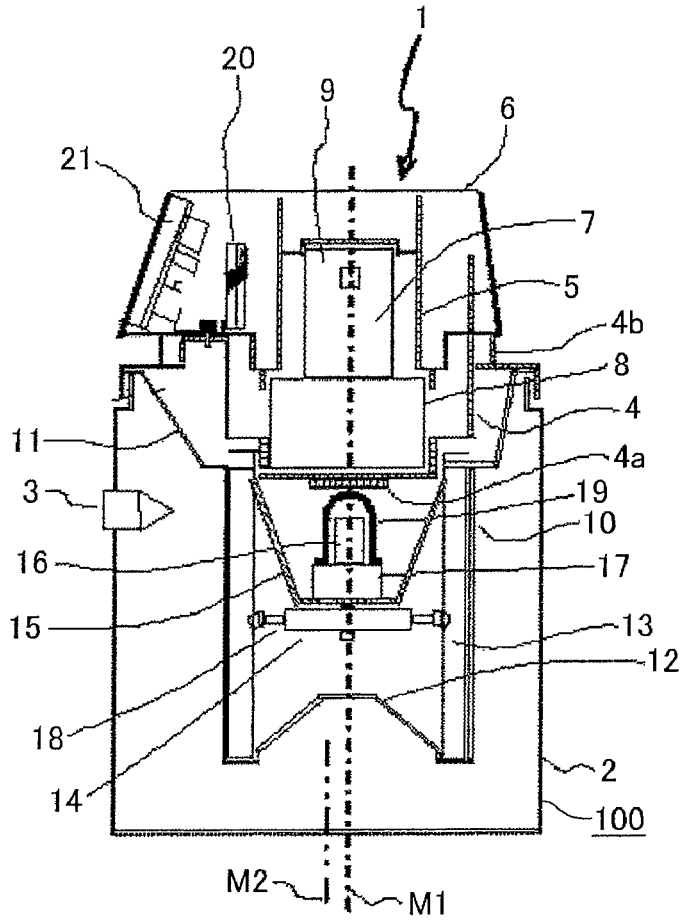
FIG. 1 is a vertical sectional view showing a dust collection device according to the present invention.

Referring to FIG. 1, a dust collector 1 has a housing 100 including a cylindrical tank 2 having a air inlet port 3 for containing dust, a main motor base 4 attached with a main motor cover 5 and a head cover 6. The main motor base 4 and the head cover 6 are clamped by a clamp member (not shown) at an upside aperture of the tank 2. The dust collector 1 includes an air suction device 7 arranged between the main motor base 4 and the motor cover 5 for aspirating powdery dust from the air inlet port 3, a filter unit 10 for capturing the aspirated powdery dust, a dust removal device 14 for removing the powdery dust deposited to the filter 13 and a control circuit 20 for controlling the air suction device 7 and the dust removal device 14, all of which are contained in the housing 100.

The air suction device 7 has a main motor 9 and a suction fan 8 driven by the main motor 9. The air suction device 7 takes in external air from the air inlet port 3 through an air intake port 4*a* formed in the main motor base 4. Additionally, the air suction device 7 guides the external air introduced in the device 7 through the discharge route defined by the main motor base 4, the main motor cover 5 and the head cover 6, and discharges the external air through an exhaust port 4*b* to the outside of the housing 100.

A filter housing 11 is fixed and attached between the upside aperture of the tank 2 and the main motor base 4. A filter device 10 is formed by the filter housing 11, the filter 13 for capturing dust and a filter cover 12, the filter 13 and the filter cover 12 being fitted to the filter housing 11. The filter cover 12 is provided to prevent the filter 13 from being crushed due to the negative pressure produced in the inside of the filter 13 as a result of the operation of the air suction device 7.

The dust removal device 14 is arranged in the space surrounded by the filter housing 11 and the filter 13. The dust removal device 14 is fitted to a dust removal device base 15 and has a DC power supply 37 (see FIG. 5), a second motor 16 driven by the DC power supply 37, an anti-dust cover 19 for protecting the second motor 16 against powdery dust, a reduction gear unit 17 coupled to the output shaft of the second motor 16 and a dust removal member 18 arranged at the output shaft of the reduction gear unit 17 and driven by the second motor 16. The dust removal member 18 removes the powdery dust deposited to the filter 13 by vibrating the filter 13, and clean the filter 13.

The air suction device 7, the filter 13, the filter cover 12 and the dust removal device 14 are aligned on a vertical line M1 extending in the vertical direction, passing through each own center. The vertical line M1 is displaced from the center line M2 of the tank 2 to the opposite side of the air inlet port 3.

Figure 2:
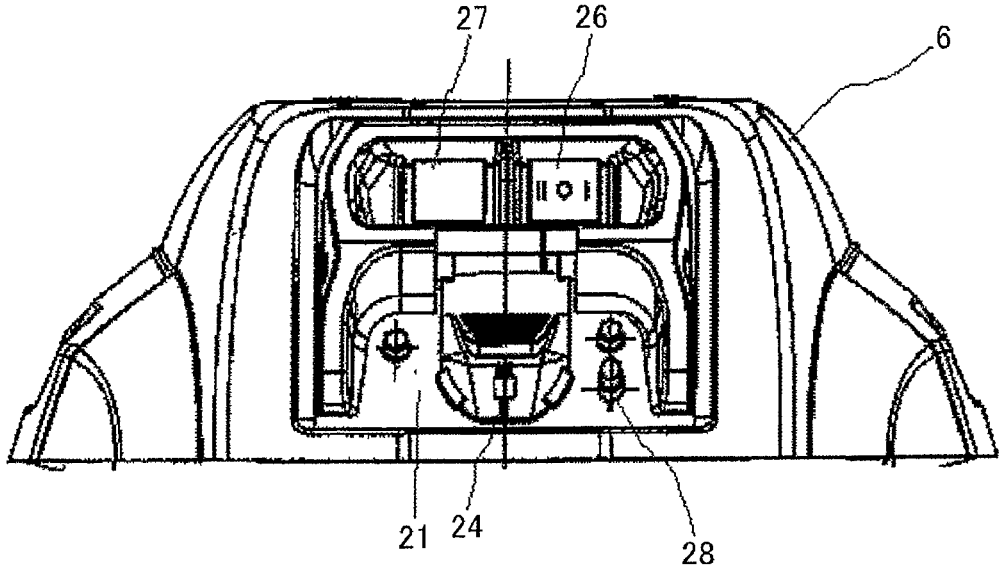
FIG. 2 is a partial side view showing an upper portion of the dust collection device of FIG. 1.

An operation panel 21 and a control circuit 20 are provided to the main motor cover 5 at respective positions located above the air inlet port 3. As shown in FIG. 2, the operation panel 21 has a plug socket 24 for supplying electric power to an external device such as an electric tool 43 (see FIG. 4), a main switch 26 for causing the dust collector 1 to start and stop operating, an interlocking mode/single mode selection switch 27 and a dust removal device switch 28. Note that the main switch 26 may have a function for selecting the dust collecting power.

Figure 3:
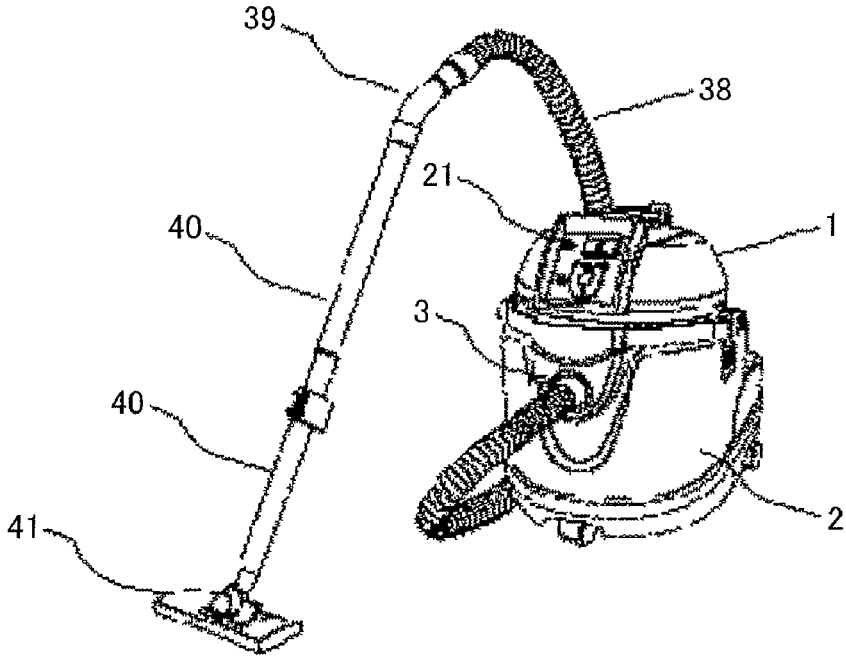
FIG. 3 is an overall view showing the dust collection device of FIG. 1.

As shown in FIG. 3, a hose 38, a hose connection handle 39, an extension tube 40 and a floor air inlet member 41 can be connected to the air inlet port 3. In this case, dust including fragments produced by cutting wood plates, stones, concrete or plaster boards can be aspirated with air.

Figure 4:
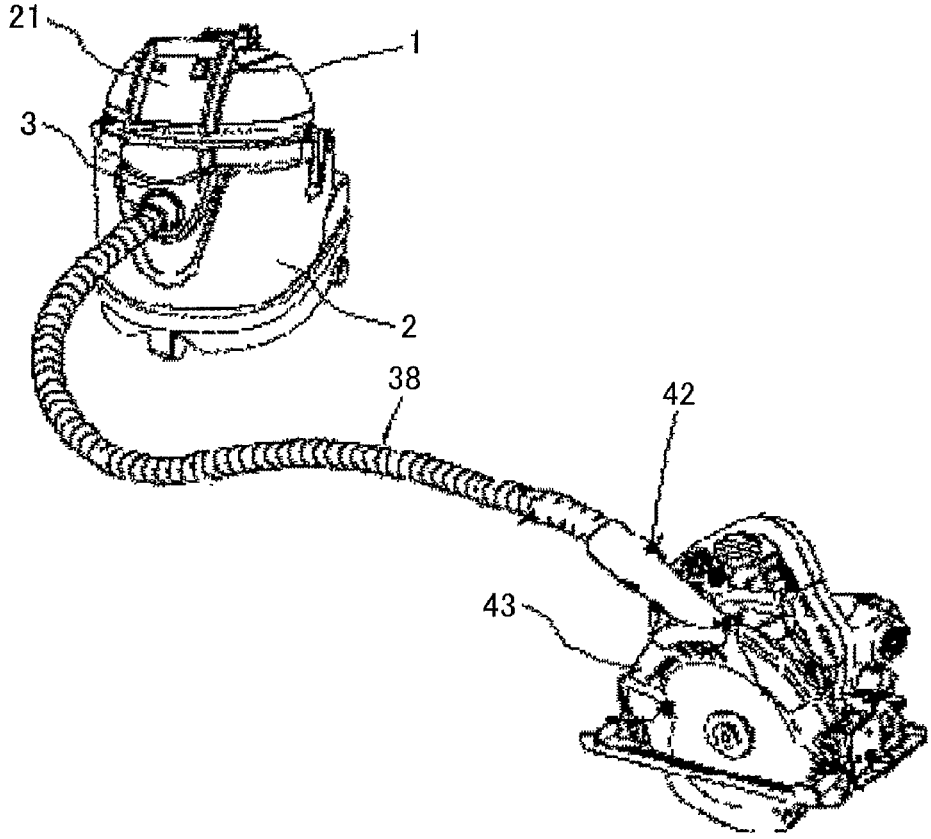
FIG. 4 is an overall view showing the dust collection device connected with an electric tool.

As shown in FIG. 4, the plug of an electric tool 43 can be inserted to the plug socket 24 of the operation panel 21 and the dust discharge port 42 of an electric tool 43 is connected to the air inlet port 3 by way of a hose 38. With this arrangement, the operation of the dust collector 1 can be interlocked with the operation of the electric tool 43 to collect the powdery dust discharged from the electric tool 43 into the tank 2.

Figure 5:
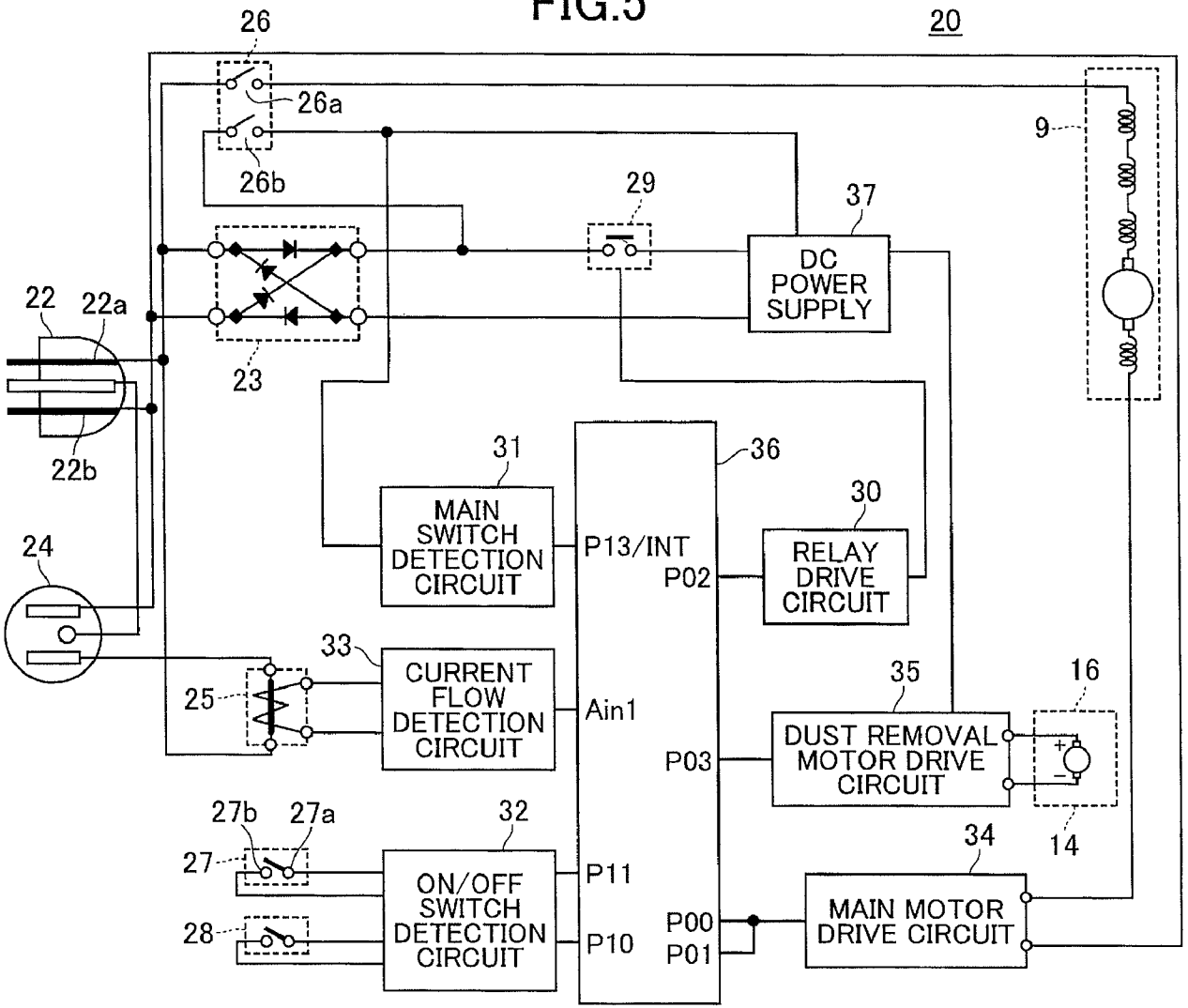
FIG. 5 is a circuit diagram showing a control circuit of the dust collection device.

Now, the control circuit 20 will be described below by referring to FIG. 5. The power source plug 22 includes a pair of terminal pieces 22*a*, 22*b* and AC 100V is supplied from a commercial power source.

The main switch 26 includes two sub-switches 26*a* and 26*b* for switching simultaneously. The plug 22 is connected to the sub-switch 26*a*, the main motor 9 and the main motor drive circuit 34 for controlling the rotary motion of the main motor 9.

The plug 22 is connected to the input side of a diode bridge 23 for full wave rectification. The sub-switch 26*b* and the DC power supply 37 are connected in series to the output side of the diode bridge 23. A relay 29 is connected in parallel with the sub-switch 26*b*. The output side of the DC power supply 37 is connected to the second motor 16.

The plug 22 is connected to the plug socket 24 that is connectable to the electric tool 43. The current detector 25 detects the electric current flowing through the plug socket 24.

The control circuit 20 includes a microcomputer 36. The output port P02 of the microprocessor 36 is connected to the relay 29 through a relay drive circuit 30. The opening and closing of the relay 29 is controlled according to the output signal from the output port P02. When the plug 22 is connected to a commercial power source and the main switch 26 is turned on, the main motor 9 starts rotating and electric power is supplied to the DC power supply 37 through the diode bridge 23 and the sub-switch 26*b*. When the main switch detection circuit 31 detects the on-status of the main switch 26, the microcomputer 36 transmits an output signal to the relay drive circuit 30 to turn on the relay 29. Then, electric power is supplied to the DC power supply 37 from two routes.

When the main switch 26 is turned off, the supply of electric power to the main motor 9 is stopped. On the other hand, the supply of electric power to the DC power supply 37 is continued as long as the relay 29 is on. Therefore, while electric power is supplied to the DC power supply 37, the second motor 16 for driving the dust removal device 14 can be operable.

The microcomputer 36 confirms the operation of the electric tool 43 connected to the plug socket 24 as follows: the microcomputer 36 first receives the input signal indicating the detection of the electric current by the current detector 25 at port Ain1 from the current detection circuit 33 and then determines based on the input signal how the electric tool 43 is operating. The electric tool 43 may be provided with a DC power source mounted therein. Therefore, the microcomputer 36 may have a function of recognizing the electric current of the DC power source mounted in the electric tool 43 and the electric current of the series commutator motor that is a drive source of the electric tool 43. Alternatively, the microcomputer 36 can determine the operating condition of the electric tool 43 by detecting the power consumption of the electric tool 43.

The microcomputer 36 determines the operating condition of the air suction device 7 on the basis of the input signal indicating the voltage of the main switch 26 when the microcomputer 36 receives the input signal at ports P13/INT through the main switch detection circuit 31. Alternatively, the microcomputer 36 can determine the operating condition of the air suction device 7 by detecting the electric current flowing through the main motor 9, the number of revolutions per unit time of the main motor 9, the internal pressure of the tank 2, the air flow rate in the hose or the wind velocity in the hose.

The suction device 7 continues operating due to the inertia of the main motor 9 after the supply of electric power to the main motor 9 is stopped. Therefore, the microcomputer 36 determines that the air suction device 7 actually stops operating, when the preset time has elapsed since the supply of electric power to the main motor 9 is stopped. The microcomputer 36 determines the stop of operation of the air suction device 7 in a similar manner when the main motor 9 is stopped by the stop signal of the air suction device 7 that is output from the port P01. The time period during which the air suction device 7 continues to operate due to the inertia is about 10 seconds.

The interlocking mode/single mode selection switch 27 is a switch for selecting either an interlocking mode or a single mode of the air suction device 7. The single mode is a mode of operation where the air suction device 7 is operated by means of the main switch 26. The interlocking mode is a mode of operation where the air suction device 7 is operated in response to the operation of the electric tool 43 connected to the plug socket 24. The interlocking mode/single mode selection switch 27 has a common terminal 27*a* and a normally open terminal 27*b*. The interlocking mode is selected when the common terminal 27*a* and the normally open terminal 27*b* are open. The single mode is selected when the common terminal 27*a* and the normally open terminal 27*b* are closed. In the interlocking mode, the air suction device 7 continues the operation thereof for a predetermined time, after the electric tool 43 stops operating and then the operation of the suction device 7 is stopped. This arrangement is aimed at preventing the hose connected between the electric tool 43 and the dust collector 1 from being clogged in an interlocking mode.

The dust removal device switch 28 is a switch for operating the dust removal device 14. When the dust removal device switch 28 is on, the dust removal device 14 is driven for a predetermined time to automatically remove the dust in the filter 13 after the supply of electric power to the air suction device 7 is stopped. In other words, the dust removal device switch 28 is effective only when the microcomputer 36 determines that the operation of the air suction device 7 has been stopped. On the other hand, when the microcomputer 36 determines that the operation of the air suction device 7 has not been stopped, the dust removal device 14 is not allowed to operate even if the dust removal device switch 28 is on. The dust deposited to the filter 13 is not removed due to the negative pressure until the air suction device 7 completely stops. Therefore, with this arrangement of the switch 28, ineffective operation of the dust removal device 15 is prevented in order to prevent waste of electric power, and the filter 13 is protected against damages.

The operation of the main motor 9 can be switched by the output signal sent from the ports P00 and P01 of the microcomputer 36. When a triac is used as an electric power control device for the main motor drive circuit 34, the suction power of the air suction device 7 can be changed by phase control of the main motor 9. Alternatively, the number of revolutions per unit time of the main motor 9 can be changed by connecting a pair of field windings to the main motor 9 and selectively operating the field windings.

The second motor 16 is operated in accordance with the output signal generated from the port P03 of the microcomputer 36 through the second motor drive circuit 35. The second motor 16 can be softly started by driving the power control device in the second motor drive circuit 35 in a chopping mode. With this arrangement, the voltage fall of the DC power supply 37 due to the starting current of the second motor can be avoided.

The dust collector 1 operates either in the single mode or in the interlocking mode.

In the single mode, the air suction device 7 is driven when the interlocking mode/single mode selection switch 27 is switched to the single mode and the main switch 26 is turned on. When the main switch 26 is turned on, the microcomputer 36 closes the contacts of the relay 29. When the main switch 26 is turned off subsequently, the supply of electric power to the main motor 9 is stopped. At this time, the supply of electric power to the DC power supply 37 is continued since the relay 29 is held on.

In the interlocking mode, the interlocked mode/single mode selection switch 27 is switched to the interlocking mode and the electric tool 43 is connected to the plug socket 24. When the main switch 26 is turned on and the microcomputer 36 determines that the electric tool 43 starts operating, the air suction device 7 starts to operate. At this time, the microcomputer 36 generates a signal from the ports P00 and P01 to drive the main motor 9 through the main motor drive circuit 34. Additionally, when the main switch 26 is turned on, the microcomputer 36 turns on the relay 29.

Thereafter, when the electric tool 43 is stopped and the electric current flowing through the plug socket 24 disappears, the microcomputer 36 determines that the electric tool 43 has stopped. Then, after the elapse of a predetermined time, the microcomputer 36 generates a signal from the ports P00 and P01 to the main motor drive circuit 34 to stop the operation of the main motor 9. Since the main switch 26 remains on at this time, the supply of electric power to the DC power supply 37 is continued.

The microcomputer 36 monitors the operation time of the air suction device 7, and determines that a dust removal operation is necessary if the operation time period of the air suction device 7 exceeds the predetermined time. On the other hand, the microcomputer 36 determines that the dust removal operation is not necessary if the operation time period of the air suction device 7 does not exceed the predetermined time. When the air suction device 7 stops, the microcomputer 36 drives the second motor 16 for several seconds to remove the dust deposited to the filter 13 by using the dust removal member 18, if dust removal for the filter 13 is necessary. The microcomputer 36 does not drive the second motor 16 when the dust removal is not necessary.

The dust removal device 14 is operated when the air suction device 7 is at rest. Therefore, when the main switch 26 is turned off, the on-status of the relay 29 is maintained for a while so that electric power is kept supplying to the DC power supply 37 to keep the dust removal device 14 ready for operation. Ten and several minutes is selected as the time period in which the on-status of the relay 29 is maintained after the stop of the power supply to the air suction device 7, considering the condition where the user manually operates the dust removal device 14. This time period corresponds to the self-holding time period of the relay 29. When the self-maintaining time period elapses, the relay 29 is turned off and the standby power of the dust collector 1 becomes practically disappeared.

Figure 6:
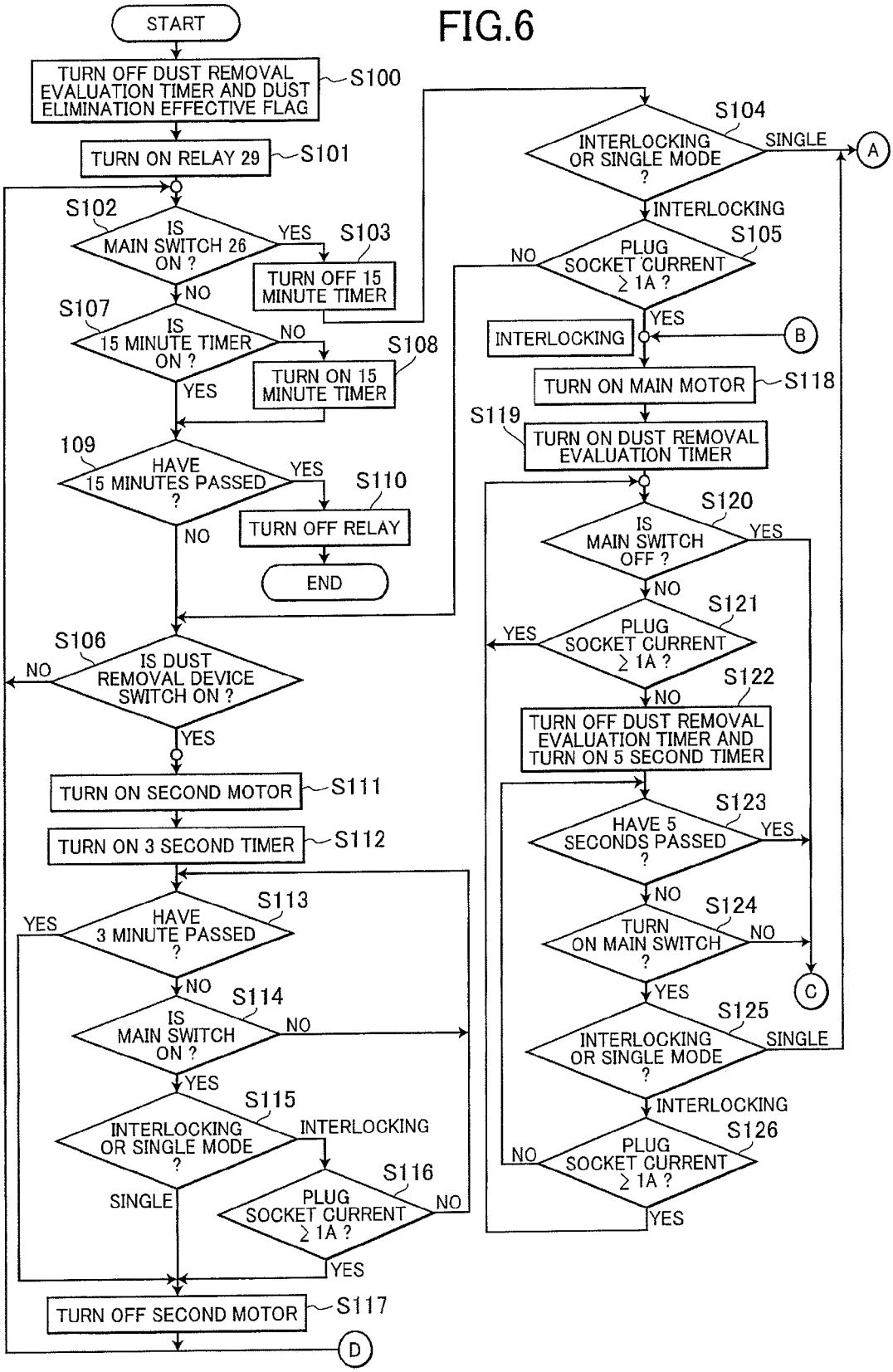
FIG. 6 is a flowchart illustrating a former portion of an operation by the dust collection device.

Now, the operation of the dust collector 1 will be described below by referring to FIGS. 6 and 7.

When the power supply plug 22 of the dust collector 1 is connected to a commercial power source and the main switch 26 is turned on, electric power is supplied to the control circuit 20 and the microcomputer 36 turns off a dust removal evaluation timer and turns off a dust removal effective flag (S100). The dust removal evaluation timer is a timer for measuring the operation time of the main motor 9. The dust removal evaluation timer is used to determine whether the operation time of the main motor 9 exceeds a predetermined time period such as 10 minutes. When a process for turning off the motor 9 has not been performed within the predetermined time period, the dust removal effective flag is changed from off to on. Then, the microcomputer 36 turns on the relay 29 (S101). The microcomputer 36 examines the status of the main switch 26 (S102). If the main switch 26 is on, the microcomputer 36 turns off a 15 minute timer (S103). The 15 minute timer is a timer for measuring the time after the power supply to the main motor 9 is stopped, in other words, the power supply suspension time. The dust removal effective flag indicates whether dust removal should be performed or not. Then, the microcomputer 36 determines whether the operation mode is a single mode or not (S104).

If the operation mode is the interlocking mode (S104: interlocking), the microcomputer 36 then determines whether the plug socket current flowing through the plug socket 24 is more than or equal to 1 A or not (S105). If the plug socket current is less than 1 A (S105: NO), the microcomputer 36 examines the condition of the dust removal device switch 28 (S106). If the dust removal device switch 28 is off (S106: NO), the microcomputer 36 returns to Step S102. The plug socket current of 1 A is the reference value for determining whether the electric tool 43 connected to the plug socket 24 is operating or not. Therefore, if the plug socket current is more than or equal to 1 A, the microcomputer 36 determines that the electric tool 43 is operating. On the other hand, if the plug socket current is lower than 1 A, the microcomputer 36 determines that the electric tool 43 is at rest.

Then, if the main switch 26 is off in Step S102 (S102: NO), the microcomputer 36 proceeds to the next step, or Step S107, where the microcomputer 36 determines whether the 15 minute timer is on or off. If the 15 minute timer is off (S107: NO), the microcomputer 36 turns on the 15 minute timer (S108). In Step S109, the microcomputer 36 determines whether the power supply suspension time is more than or equal to 15 minutes or not. If the power supply suspension time is less than 15 minutes (S109: NO), the microcomputer 36 proceeds to Step S106. On the other hand, if the power supply suspension time is determined to be more than or equal to 15 minutes (S109: YES), the microcomputer 36 turns off the relay 29 and stops the operation of the dust collector 1 in Step S110.

The microcomputer 36 determines in Step S106 whether the dust removal device switch 28 is on or off. At this case, the supply of electric power to the main motor 9 is stopped. Accordingly, the dust removal device switch 28 is effective for operating the dust removal device. If the dust removal device switch 28 is turned on (S106: YES), the dust removal device can be started. Therefore, the microcomputer 36 starts the second motor 16 in Step S111 and then starts a 3 second timer in Step S112. The 3 second time is a timer for measuring the operation time of the dust removal device 14.

Then, the microcomputer 36 sequentially determines whether the operation time of the dust removal device 14 exceeds 3 seconds or not (S113), whether the main switch 26 is on or not (S114), whether the current operation mode is an interlocking mode or a single mode (S115), and whether the plug socket current is more than or equal to 1 A or not (S116) when the current mode of operation is an interlocking mode. The above steps are a process for driving the dust removal device 14 for 3 seconds and then stopping the dust removal device 14.

While the steps S113-S116 are processed, if it is determined that the main switch 26 is on (S114: YES) and that the current mode of operation is a single mode (S115: YES), the microcomputer 36 proceeds to Step S117, where the microcomputer 36 stops the second motor 16. On the other hand, if the current mode of operation is the interlocking mode (S115: interlocking), and the plug socket current is more than or equal to 1 A (S116: YES), the microcomputer 36 proceeds to Step S117, where the microcomputer 36 stops the second motor 16. With these steps, the operation of the dust removal device 14 can be suspended when the air suction device 7 starts operating while the second motor 16 is in operation. When the operation time of the dust removal device 14 exceeds 3 seconds (S113: YES), the microcomputer 36 stops the rotation of the second motor 16 (S117).

On the other hand, if the microcomputer 36 determines in Step S102 that the main switch 26 is on, that the current mode is the interlocking mode in Step S104 (S104: interlocking) through Step S103 and that the plug socket current is more than or equal to 1 A in Step S105 (S105: YES), the microcomputer 36 proceeds to Step S118. The subsequent process is a process for the interlocking mode. Then, the microcomputer 36 turns on the main motor 9 in Step S118 and starts the dust removal evaluation timer in Step S119. The microcomputer 36 determines whether the main switch 26 is on or off (S120) and whether the plug socket current is more than or equal to 1 A or not (S121).

If the microcomputer 36 determines in Step S120 that the main switch 26 is off, the microcomputer 36 proceeds to Step S132. If the microcomputer 36 determines in Step S121 that the plug socket current is less than 1 A, the microcomputer 36 proceeds to Step S122, where the microcomputer stops the dust removal evaluation timer and starts a five second timer. The five second timer is a timer for measuring the operation time during which the air suction device 7 is driven after stopping the electric tool 43. The microcomputer 36 determines whether the reading of the five second timer exceeds five seconds or not in S123, whether the main switch 26 is on or not in S124, whether the current mode of operation is a single mode or an interlocking mode in S125 and whether the plug socket current is not less than 1 A or not in S126. The steps from S123 to S126 are a process for waiting for the elapse of the preset time from the time when the air suction device 7 starts operating and to the time when the air suction device 7 stops operating in the interlocking mode.

Figure 7:
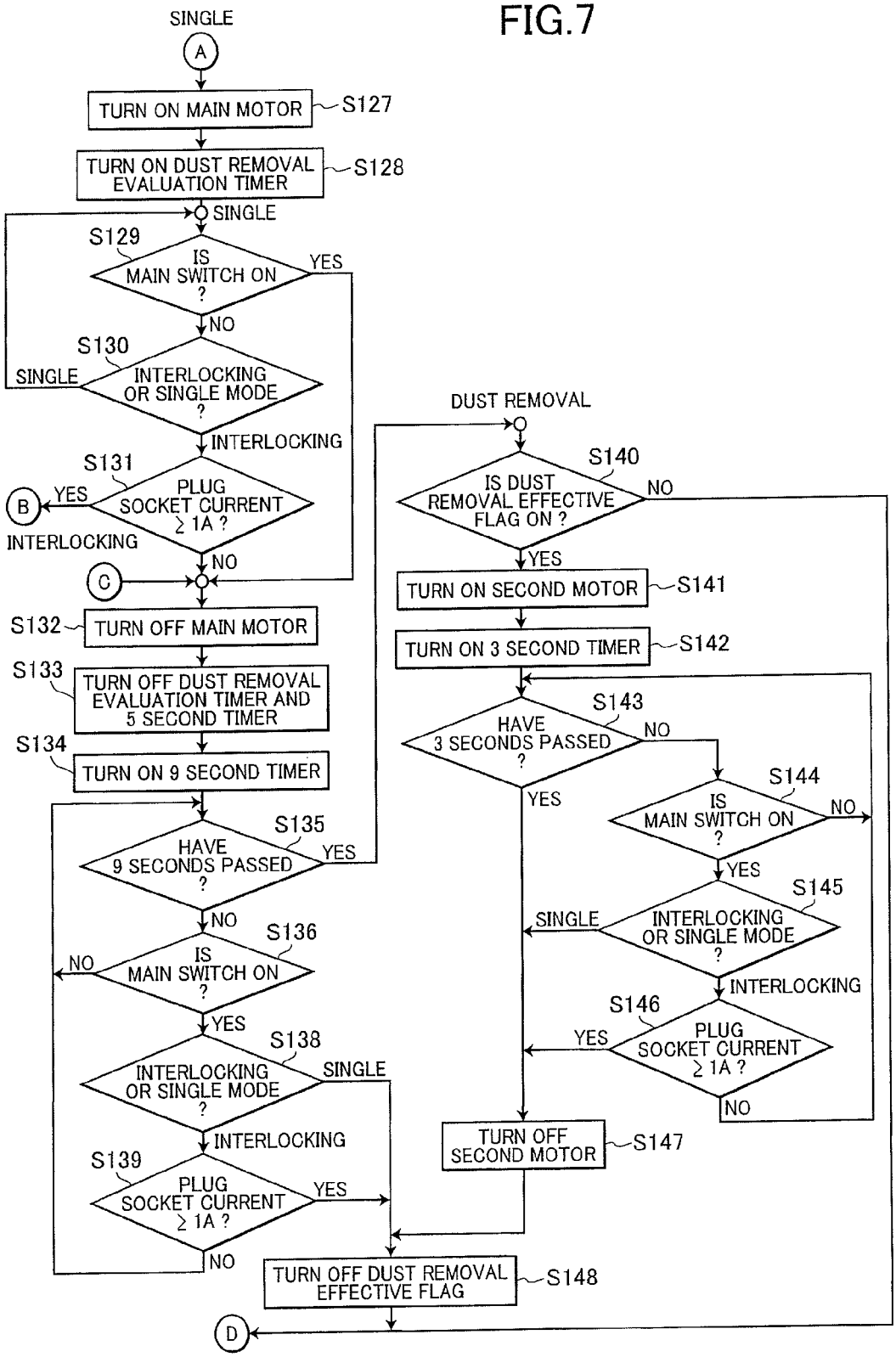
FIG. 7 is a flowchart illustrating a latter portion of the operation by the dust collection device shown in FIG. 6.

If the microcomputer 36 determines in Step S104 that the current mode of operation is the single mode, the microcomputer 36 proceeds to Step S127 (FIG. 7). The subsequent process is a process for a single mode. The microcomputer 36 turns on the main motor 9 in S127 and starts the dust removal evaluation timer in S128. Then, the microcomputer 36 determines whether the main switch 26 is on or off in Step S129 and which the current mode of operation is in Step S130. The steps of S129 and S130 are a process for determining whether the main switch 26 for stopping the air suction device 7 is off or not and whether the operation mode is switched or not. When the microcomputer 36 determines in Step S129 that the main switch 26 is turned off (S129: YES), the microcomputer 36 proceeds to Step S132. If the microcomputer 36 determines in Step S130 that the current mode of operation has been switched to the interlocking mode (S130: interlocking), the microcomputer proceeds to Step S131, where the microcomputer determines whether the plug socket current is more than or equal to 1 A or not. When the plug socket current is not less than 1 A (S131: YES), the microcomputer 36 proceeds to Step S118. On the other hand, when the plug socket current is less than 1 A (S131: NO), the microcomputer proceeds to Step S132.

The following steps from Step S132 are a process for stopping the air suction device 7. The microcomputer 36 turns off the main motor 9 in Step S132, turns off the dust removal timer, and starts the five second timer in Step S133. Then, in Step S134, the microcomputer 36 starts a 9 second timer. The 9 second timer is a timer for measuring the time elapsed from the time when the supply of electric power to the main motor 9 is stopped to the time when the internal pressure of the filter 13 becomes equal to the atmospheric pressure from the previous negative pressure. Then, the microcomputer 36 determines whether the reading of the 9 second timer exceeds 9 seconds or not in Step S135 and whether the main switch 26 is on or off in Step S136. When the microcomputer determines that the main switch 26 is not on in Step S136, the microcomputer 36 returns to Step S135.

On the other hand, when the microcomputer determines in Step S136 that the main switch 26 is on, the microcomputer 36 determines in Step S138 whether the current mode of operation is a single mode or not. If the microcomputer 36 determines in Step S138 that the current mode of operation is not the single mode, the microcomputer proceeds to Step S139, where the microcomputer measures the plug socket current. When the plug socket current is less than 1 A (S139: NO), the microcomputer 36 returns to Step S135. The steps from S135 to S139 are a process for standing by the dust removal device 14 until the internal pressure of the filter restores the atmospheric pressure.

If the microcomputer 36 determines in Step S135 that the reading of the 9 second timer exceeds 9 seconds (S135: YES), the microcomputer proceeds to Step S140, where the microcomputer executes an automatic dust removal process. When the microcomputer determines in Step S136 that the main switch 26 is on and in Step S138 that the current mode of operation is a single mode (S138: YES), the microcomputer 36 proceeds to Step S148. However, when the microcomputer determines in Step S138 that the current mode of operation is the interlocking mode (S138: interlocking) and in Step S139 that the plug socket current is more than or equal to 1 A (S139: YES), the microcomputer 36 also proceeds to Step S148.

The following process starting from Step S140 is the automatic dust removal process for removing dust from the filter 13 to clean the filter 13. The microcomputer 36 examines the dust removal effective flag in Step S140. If the dust removal effective flag is not ON, the microcomputer 36 returns to Step S102 and does not execute the automatic dust removal operation. On the other hand, if the dust removal effective flag is ON, the microcomputer 36 starts rotating the second motor 16 in Step S141 and also starts a 3 second timer in Step S142. The 3 second timer is a timer for measuring the operation time of the dust removal device 14. In this embodiment, the operation time of the dust removal device 14 is set as 3 seconds. Then, the microcomputer 36 determines whether the reading of the 3 second timer exceeds 3 seconds or not in Step S143. If the microcomputer 36 determines in Step S143 that the reading of the 3 second timer exceeds 3 seconds (S143: YES), the microcomputer proceeds to Step S147, where the microcomputer stops the rotation of the second motor 16 to finish the automatic dust removal process.

On the other hand, if the microcomputer 36 determines in Step S143 that the reading of the 3 second timer is less than 3 seconds (S143: NO), the microcomputer determines whether the main switch 26 is on or off in Step S144. when the main switch 26 is off (S144: NO), the microcomputer 36 returns to Step S143. On the other hand, when the main switch 26 is on (S144: YES), the microcomputer 36 examines the current mode of operation in Step S145. If the current mode of operation is the interlocking mode (S145: interlocking), the microcomputer 36 determines whether the plug socket current is more than or equal to 1 A or not in Step S146. If the main switch 26 is turned on, or the current mode of operation is switched to the interlocking mode and the operation of the electric tool 43 is confirmed while the dust removal device 14 is automatically operating, the microcomputer 36 proceeds to Step S147, where the microcomputer stops the second motor 16 to finish the automatic dust removal process.

After S147, the microcomputer 36 turns off the dust removal effective flag in Step S148 and returns to Step S102.

A swinging vibrator may be used as the drive source of the dust removal member 18 in other embodiments.

According to the present invention, the dust removal device is automatically activated when the air suction device operates for a predetermined time period and stops operating. Accordingly, dust is reliably removed from the filter device. A reduction in the suction force can be prevented effectively.

The dust removal device automatically starts operating only when the operation time of the air suction device exceeds a predetermined time. In other words, the filter is cleaned by the dust removal process when the filter device is considered to be significantly clogged. Thus, the dust removal device can enjoy a prolonged service life because the dust removal device is operated only in limited occasions.

The dust removal device starts operating when a predetermined time has elapsed since the supply of electric power to the air suction device is stopped. This structure ensures that dust can be removed from the filter after the internal pressure of the filter restores the atmospheric pressure. Therefore, dust can be removed efficiently from the filter.

It is understood that the foregoing description and accompanying drawings set forth the embodiments of the invention at the present time. Various modifications, additions and alternative designs will, of course, become apparent to those skilled in the art in light of the foregoing teachings without departing from the spirit and scope of the disclosed invention. Thus, it should be appreciated that the invention is not limited to the disclosed embodiments but may be practiced within the full scope of the appended claims.

What is claimed is:

1. A dust collection device comprising:

a tank having an air inlet for accommodating dust;

a suction unit for aspirating the dust through the air inlet;

a filtering unit for capturing the dust through the air inlet;

a dust removal unit for removing the dust from the filtering unit;

a first detection unit for detecting an operational state of the suction unit; and a control unit for controlling the suction unit and the dust removal unit, wherein the control unit activates the dust removal unit, when the first detection unit detects that the suction unit operates for a first predetermined time period and then stop operating.

2. The dust collection device as claimed in claim 1, further comprising:

a switching unit for turning on and off the suction unit; wherein the control unit activates the dust removal unit, when the first detection unit detects that the suction unit operates for more than the first predetermined time period and the switching unit then turns off the suction unit.

3. The dust collection device as claimed in claim 2, wherein the control unit activates the suction unit a second predetermined time period after the switching unit turns off the suction unit.

4. The dust collection device as claimed in claim 1, further comprising:

a receptacle unit connectable to an external device for feeding electric power to the external device; and a second detection unit for detecting an operational state of the external device; wherein the control unit activates the dust removal unit when the second detection unit detects that the external device stops operating.

5. The dust collection device as claimed in claim 4, wherein the control unit activates the suction unit when the second detection unit detects that the external device connected to the receptacle unit operates for a third predetermined time period and then stops operating.

6. The dust collection device as claimed in claim 4, wherein the control unit activates the dust removal unit a forth predetermined time period after the second detection unit detects that the external device connected to the external device stops operating.

7. The dust collection device as claimed in claim 1, wherein the dust removal unit operates for a fifth predetermined time period and then stops operating.

8. The dust collection device as claimed in claim 1, wherein the tank has a cylindrical shape, the suction unit is provided above the tank, the filtering unit includes a filter member provided inside of the tank, the dust removal unit includes a dust removal member and a motor for driving the dust removal member, the dust removal member being provided inside of the filter member and rotated to move the filter member.

* * * * *